US007024143B2

(12) United States Patent
Nowak et al.

(10) Patent No.: US 7,024,143 B2
(45) Date of Patent: Apr. 4, 2006

(54) XEROGRAPHIC PRINTER SPLIT DRIVE SYSTEM TO REDUCE IMAGE SMEAR

(75) Inventors: William J. Nowak, Webster, NY (US); Sushant G. Gaonkar, Rochester, NY (US); James M. Casella, Webster, NY (US); Igor A. Podzorov, Webster, NY (US); David K. Shogren, Ontario, NY (US); William J. Cecchi, Webster, NY (US)

(73) Assignee: Xerox Corporation, Stamford, CT (US)

( * ) Notice: Subject to any disclaimer, the term of this patent is extended or adjusted under 35 U.S.C. 154(b) by 75 days.

(21) Appl. No.: 10/936,961

(22) Filed: Sep. 9, 2004

(65) Prior Publication Data

US 2006/0051141 A1 Mar. 9, 2006

(51) Int. Cl.
*G03G 15/20* (2006.01)

(52) U.S. Cl. ..... 399/322; 399/329

(58) Field of Classification Search ..... 399/68, 399/122, 167, 328, 329, 394; 219/216
See application file for complete search history.

(56) References Cited

U.S. PATENT DOCUMENTS 5,216,475 A * 6/1993 Ohno ..... 399/75
5,243,396 A 9/1993 Castelli et al.
5,257,070 A 10/1993 Miller et al.
5,287,160 A * 2/1994 Dastin et al. ..... 399/301
5,444,525 A * 8/1995 Takahashi et al. ..... 399/76

* cited by examiner

*Primary Examiner*—Hoang Ngo

(57) ABSTRACT

A split drives system for a printer in which a single drive motor drives a first belt drive system for the image fusing system and a second and separate belt drive system driving the sheet registration system. This split drives system mechanically isolates the second and separate belt drive system from torque fluctuations in the image fusing system via the first belt drive system driving the image fusing system. Also, the split driving system can isolate torque variations in the driving of the print media fuser from the driving of the print media sheet transport.

4 Claims, 1 Drawing Sheet

XEROGRAPHIC PRINTER SPLIT DRIVE SYSTEM TO REDUCE IMAGE SMEAR

Figure 1:
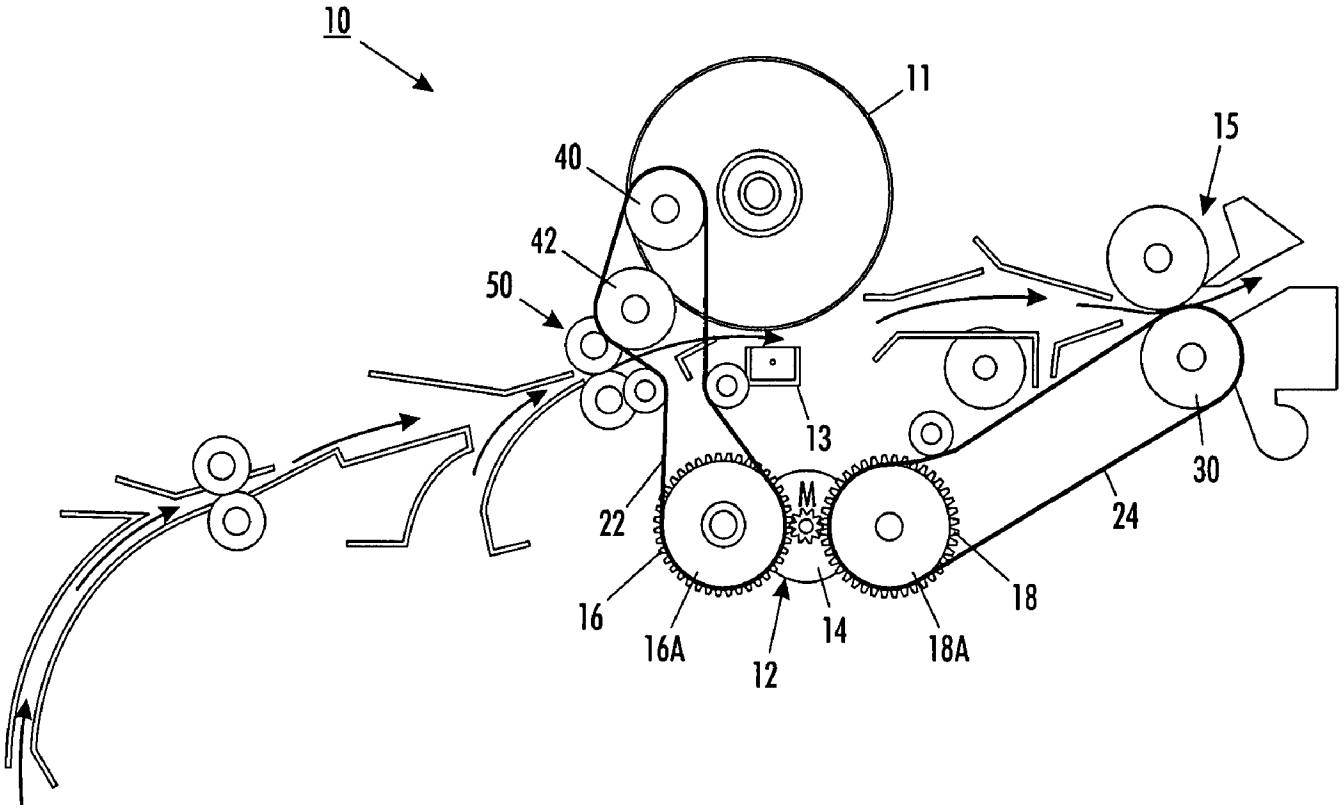

The disclosed embodiment is particularly suitable for low cost compact drive systems for small xerographic printers, but is not limited thereto. It enables the use of a single drive motor through an appropriate split drive system with separate drive belt systems for the fuser versus other critical driven elements. This can sufficiently isolate transients occurring from heavy weight paper transitions in and out of a fuser roll system from being transmitted back through the drive system. For example, to the sheet registration drive system for sheets being fed to the photoreceptor for image transfer. The disclosed split drive system can also enable the utilization of a high inertia single main drive to benefit the smoothness of the fuser roll motion without requiring inertia wheels or increased mass on the fuser rolls. A split drive system can isolate both the developer drive system and sheet registration drive system from the fuser drive to eliminate "cross-talk" for sheets of paper being fed through the image transfer system in engagement with the photoreceptor, during which critical time period transients in the sheet motion could cause the sheet to move at a different surface velocity than the photoreceptor and therefore cause partial smearing of the toner image being transferred to the sheet.

The inventors are not yet aware of any specific prior xerographic printer split drive systems. However, they may exist in larger and more expensive printers. (Perhaps by a separate fuser drive motor?) That is, it is believed that others more commonly use a distributed drive approach with independent motors for critical motion components to obtain good quality drives that will not interact. Noted are Xerox Corp. U.S. Pat. No. 5,257,070 issued Oct. 26, 1993 by Donald L. Miller, et al, entitled "Selective Control of Distributed Devices to Maintain Interdocument Gap During Jam Recovery Purge," and U.S. Pat. No. 5,243,396 issued Sep. 7, 1993 by Vittorio Castelli, et al, entitled "Design Rules for Image Forming Devices to Prevent Image Distortion and Misregistration" (which discusses belt drives with speed reduction in a xerographic printer).

A specific feature of the specific embodiment disclosed herein is to provide a reproduction system in which an image is transferred from an image bearing surface with a defined surface velocity to an image print media sheet at a transfer station, into which transfer station the sheet is fed from a sheet registration system with the same surface velocity as said image bearing surface, and which reproduction system has an image fusing system through which said sheet is subsequently fed, there is provided a split drives system in which a single drive motor drives a first belt drive system for said image fusing system and a second and separate belt drive system driving said sheet registration system, which split drives system mechanically isolates said second and separate belt drive system from torque fluctuations in said image fusing system via said first belt drive system driving said image fusing system.

Further specific features disclosed in the embodiment herein, individually or in combination, include those wherein said single drive motor has a small diameter drive pinion gear and said small diameter drive pinion gear is engaged on opposite sides thereof by larger diameter first and second driven gears, said first gear driving said first belt drive system and said second gear driving said second belt drive system; and/or a method of driving both a print media fuser and a print media sheet transport for image transfer to said print media sheets with the same drive motor, comprising a split driving system for isolating torque variations in the driving of said print media fuser from the driving of said print media sheet transport by a high gear ratio driving connection between said drive motor and said driving of print media fuser and a belt drive connection from said high gear ratio driving connection to said print media fuser, and a second and separate belt drive system from said drive motor to said print media sheet transport; and/or wherein said second and separate belt drive system from said drive motor to said print media sheet transport is through a second and separate high gear ratio driving connection between said drive motor and said second and separate belt drive system.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, they will be better understood from this description of this specific embodiment, including the drawing FIGURE (which is approximately to scale) wherein:

FIG. 1 is a schematic side view of an exemplary compact xerographic printer with one example of a split drive system.

Shown in the FIGURE is an exemplary compact (short paper path) xerographic printer 10 with an exemplary split drive system 12. This printer 10 has a conventional xerographic photoreceptor 11, image transfer system 13 and roll fuser system 15. Here, in this example, a single relatively high rotary inertia main electric drive motor M drives the split drive system 12 through a small diameter main motor drive pinion 14. This drive pinion 14 in turn drives much larger diameter gears 16 and 18 with directly axially mounted larger diameter pulleys or pinions 16A and 18A respectively driving separate drive belts 22 and 24, to provide two separated drive systems. The belt 24 directly drives the fuser drive pinion 30, while the belt 22 drives both the developer drive pinion 40 and the registration drive coupling 42 of the sheet registration system 50.

The belts 22 and 24 are preferably cogged or gear belts providing non-slip drives. As shown, idlers engaging the belt may be utilized to conform the belts to a desired path.

Investigations of prior similar but single drive printers led to a conclusion that image smears could be attributed to fuser system 15 torque transients caused by heavier papers passing squarely into the fuser rolls nip, thereby causing a torque increase at the paper lead edge, and a torque decrease at the paper trail edge. With such fuser system torque transients, the paper can slow down and speed up at a common drive transfer nip, to cause image smears where that fuser torque transient is transmitted through the common drive system, by disturbing the image during the transfer of the unfused toner from the photoreceptor 11 surface to the sheet at the transfer station 13.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. In a reproduction system in which an image is transferred from an image bearing surface with a defined surface velocity to an image print media sheet at a transfer station, into which transfer station the sheet is fed from a sheet registration system with the same surface velocity as said image bearing surface, and which reproduction system has an image fusing system through which said sheet is subsequently fed, there is provided a split drives system in which a single drive motor drives a first belt drive system for said image fusing system and a second and separate belt drive system driving said sheet registration system, which split drives system mechanically isolates said second and separate belt drive system from torque fluctuations in said image fusing system via said first belt drive system driving said image fusing system.

2. The reproduction system of claim 1, wherein said single drive motor has a small diameter drive pinion gear and said small diameter drive pinion gear is engaged on opposite sides thereof by larger diameter first and second driven gears, said first gear driving said first belt drive system and said second gear driving said second belt drive system.

3. In a printer, a method of driving both a print media fuser and a print media sheet transport for image transfer to said print media sheets with the same drive motor, comprising a split driving system for isolating torque variations in the driving of said print media fuser from the driving of said print media sheet transport by a high gear ratio driving connection between said drive motor and said driving of print media fuser and a belt drive connection from said high gear ratio driving connection to said print media fuser, and a second and separate belt drive system from said drive motor to said print media sheet transport.

4. The method of claim 3, wherein said second and separate belt drive system from said drive motor to said print media sheet transport is through a second and separate high gear ratio driving connection between said drive motor and said second and separate belt drive system.

* * * * *